US008942405B2

(12) United States Patent
Jones et al.

(10) Patent No.: US 8,942,405 B2
(45) Date of Patent: Jan. 27, 2015

(54) EARPHONE DEVICE

(71) Applicants: Owen Jones, Ipswich (GB); Lawrence R. Fincham, Santa Rosa, CA (US)

(72) Inventors: Owen Jones, Ipswich (GB); Lawrence R. Fincham, Santa Rosa, CA (US)

(73) Assignee: THX, Ltd, San Francisco, CA (US)

( * ) Notice: Subject to any disclaimer, the term of this patent is extended or adjusted under 35 U.S.C. 154(b) by 0 days.

(21) Appl. No.: 13/867,956

(22) Filed: Apr. 22, 2013

(65) Prior Publication Data

US 2014/0097033 A1 Apr. 10, 2014

Related U.S. Application Data

(62) Division of application No. 12/263,145, filed on Oct. 31, 2008, now Pat. No. 8,447,059.

(60) Provisional application No. 60/984,367, filed on Oct. 31, 2007.

(51) Int. Cl.
*H04R 25/00* (2006.01)
*H04R 1/10* (2006.01)

(52) U.S. Cl.
CPC ..... *H04R 1/1016* (2013.01); *H04R 25/656* (2013.01); *H04R 25/652* (2013.01)
USPC ..... 381/380; 381/371

(58) Field of Classification Search
CPC ... H04R 1/1016; H04R 25/652; H04R 25/656
USPC ..... 381/187, 371, 380
See application file for complete search history.

(56) References Cited

U.S. PATENT DOCUMENTS 3,724,961 A 4/1973 Levoin
4,539,440 A 9/1985 Sciarra
(Continued)

FOREIGN PATENT DOCUMENTS

EP 1434464 6/2004
EP 1653776 5/2006
(Continued)

OTHER PUBLICATIONS

"A Small Headphone Survey or Banging on Three Sets of Cans Beyerdynamic DT831,Etymotic ER4S, Sennheiser HD600" Enjoy the Music.com, May 2002.
(Continued)

*Primary Examiner* — A. Sefer
(74) *Attorney, Agent, or Firm* — Irell & Manella LLP

(57) ABSTRACT

An earphone device comprises an inner casing enclosing one or more miniature drive units, and a movable cap or outer casing that moves relative to the inner casing. The inner casing has an extension member, such as a hollow post, terminating in an acoustic output port. A compressible foam bulb at least partially surrounds the extension member, and is decompressed and compressed by actuation of an adjustable member. The adjustable member may take the form, for example, of a pivoting lever, a helical cam, or a push-rod mechanism, among other things. A flange may be disposed around the periphery of the movable cap, in order to provide a seal surrounding the ear canal region. The compressible material may be gripped by the hollow extension member, and abut the movable cap or flange. Through actuation of the adjustable member, the compressible material may be decompressed and thus elongated for insertion into the wearer's ear, and may be compressed and thus widened or expanded to form an adequate seal with the wearer's ear canal region.

23 Claims, 6 Drawing Sheets

(56) References Cited

U.S. PATENT DOCUMENTS

| | | | |
|---|---|---|---|
| 6,256,396 | B1 | 7/2001 | Cushman |
| RE38,351 | E | 12/2003 | Iseberg et al. |
| 6,778,676 | B2 | 8/2004 | Groth et al. |
| 6,921,225 | B1 | 7/2005 | Hsu |
| 6,931,142 | B2 | 8/2005 | Fushimi |
| 7,349,547 | B1 | 3/2008 | Isvan |
| RE40,696 | E | 4/2009 | Iseberg et al. |
| 2002/0196958 | A1 | 12/2002 | Halteren et al. |
| 2004/0215053 | A1 | 10/2004 | Jorgensen et al. |
| 2005/0226453 | A1 | 10/2005 | Kamo et al. |
| 2006/0042868 | A1 | 3/2006 | Berg et al. |
| 2006/0133636 | A1 | 6/2006 | Harvey et al. |
| 2007/0129828 | A1 | 6/2007 | Lee et al. |
| 2007/0189570 | A1 | 8/2007 | Matsuo et al. |
| 2008/0101643 | A1 | 5/2008 | Shyu et al. |
| 2008/0226114 | A1 | 9/2008 | Thompson et al. |
| 2009/0110223 | A1 * | 4/2009 | Semcken ..... 381/329 |

FOREIGN PATENT DOCUMENTS

| | | |
|---|---|---|
| EP | 1 937 031 | 6/2008 |
| GB | 2323295 | 9/1998 |
| JP | 8098290 | 4/1996 |
| WO | 2004100608 | 11/2004 |

OTHER PUBLICATIONS

Berger, Elliott H., "The Naked Truth About NRRs", EARLOG, Copyright 2000.

PCT Search Report and Written Opinion, from PCT/US2008/082092, THX Ltd., dated Aug. 5, 2009.

* cited by examiner

EARPHONE DEVICE

RELATED APPLICATION INFORMATION

This application is a divisional of U.S. patent application Ser. No. 12/263,145, filed Oct. 31, 2008, which claims the benefit of U.S. Provisional Application Ser. No. 60/984,367, filed on Oct. 31, 2007, both of which are hereby incorporated by reference as if set forth fully herein.

BACKGROUND OF THE INVENTION

1. Field of the Invention

The field of the present invention relates to earphone devices for acoustic sound reproduction.

2. Background

The advent of MP3 players has led to a greater uptake of earbud style earphones for listening to music. There are two general categories of conventional earbud earphones: (i) those that simply rest in the Concha in proximity to the ear canal, and (ii) those that effect some form of contact with the ear canal to attempt to form an acoustic seal.

The former category have no means of sealing to the ear and suffer from, among other things, poor bass response, very little sound isolation and an insecure fit in the ear.

The latter type, often known as insertion earbuds, form a seal to the ear canal by protruding into the ear canal to a greater or lesser extent and using some form of flexible element to make contact with the ear canal. They offer improved bass response, improved isolation and a more secure fit than proximity type earbuds. In practice however, the efficacy of the seal falls far short of the ideal and leads to a loss in bass performance, isolation, fit and comfort.

In order to reproduce a deep bass response, the earbud should effectively seal to the ear canal so as to minimize air leakage between the earbud speaker and the ear canal. If significant air leakage exists between the earbud and the ear canal, the frequency response at the eardrum will exhibit a falling bass response—the larger the leak, the higher in frequency that the bass response will begin to fall. The seal of an insertion type earbud is generally achieved by some means of flexible cushion that fits to the ear canal or ear canal entrance. The bass response is also affected by the acoustic impedance of this cushion. If the impedance is too low, then the bass response will be lowered.

Attempts to compensate for the bass response problems experienced with insertion type earbuds have generally been unsuccessful. Attempting to compensate for the falling bass response by the use, for example, of a suitable equalizing filter prior to the amplifier driving the earbud can lead to overload problems. The air leak lowers the acoustic impedance into which the earbud drive unit operates; thus, to maintain a given level of bass output, the drive unit has to be driven harder to produce more displacement, and the amplifier must produce a commensurately greater output level. Both these factors result in higher distortion from the earbud and a reduced maximum output level capability. The requirement for increased drive is difficult enough with moving coil drive units, but is particularly problematical with earbuds that make use of miniature balanced armature drive units which typically have a much lower acoustic volume velocity capability at low frequencies.

The quality or characteristics of the seal relative to the ear canal can also affect the acoustic isolation characteristics of the earbud. The better the seal, i.e., the less air leakage, the greater the acoustic isolation, particularly at low frequencies. Insertion type earbuds are often worn in environments where their ability to block external noise is important, thereby allowing listening at safe audio levels in the presence of significant environmental noise, such as on planes, public transport etc. A poor seal will greatly reduce the ability of the earbud to block external noise, particularly at lower frequencies, and any attempt to make the low frequencies more audible by boosting the volume could, for example, lead to damaging playback levels or increased distortion.

In addition to the ability to minimize air leaks, the acoustic impedance of the cushion employed to effect the seal is also important. If the cushion is too light and flimsy, it will have a low acoustic impedance and will act as a poor barrier to external noise, irrespective of its effectiveness in eliminating acoustic air leaks.

In prior art earbuds such as the ER4S® earphone made by Etymotic Research, Inc., the seal has typically been implemented by one of two means. The first is shown in FIG. 1 and comprises a three-tiered 'mushroom' tip that is attached to the output port of the earbud housing. A tight seal is maintained between the housing and the tip so that, ideally, no acoustic leak occurs between the two. The mushroom tip is inserted into the ear canal so that one or more of the mushroom caps makes contact with the walls of the ear canal to effect a seal. Due to the differing dimensions of the ear canal from person to person, ear tips are made available in different sizes, and the user must determine by feel and by listening to audio just which is the most appropriate tip. However, in order to effect a suitable seal, the tip has to be inserted quite deeply into the ear canal and can prove uncomfortable so that many users do not in practice get the benefit of a sufficiently complete seal. Also, due to the deep insertion, the tip often picks up ear wax that is not easily accessible to removal when cleaning the ear canal.

There is a further drawback of such earbuds even when a good seal is obtained, which is related to the limited ability of the seal to block external noise. The mushroom tip caps are made of a very thin silicone rubber so that they will deform easily when inserted into the ear canal. However, this flexibility is detrimental to the ability of the cushion to block external noise. Graph 301 in FIG. 3 shows the acoustic attenuation of an example earbud in a real ear using a mushroom cap (as compared to the attenuation of a foam cap, discussed below). As can be seen, the high frequency attenuation levels off above a few hundred Hertz instead of continuing to improve with increasing frequency.

An alternative method is to use a slow recovery polyurethane foam cushion, similar to the earplugs used for protection in noisy environments. Such a scheme is offered with the ER4® earphone as an alternative to the mushroom tip and is shown in FIG. 2. The foam cushion has to be carefully rolled to compress the foam prior to insertion in the ear canal, taking care not to cause creases in the foam that would prevent even expansion once inserted into the ear canal. Once compressed, the foam cushion is pushed into the ear canal, as deep as possible, whereupon it expands to make contact with the ear canal walls and effect an acoustic seal. In order to make an effective seal, the expansion of the foam has to be significant and this leads to a feeling of pressure in the ear canal once fully inserted, which can lead to discomfort. The same problems exist as with the mushroom cap in respect of picking up earwax.

The acoustic impedance of the foam cushion can be significantly higher than that of the mushroom cap however, leading to a greater isolation at high frequencies. This can be seen by again referring to the acoustic attenuation graph shown in FIG. 3, and in particular to graph 305. The lower frequency attenuation is similar for both cushions, indicating that a reasonable low frequency seal has been obtained for both cushions, but the high frequency attenuation of the foam cushion as shown by graph 305 is clearly superior.

A problem alluded to in the above description is the requirement for the wearer to select the correct size cushion and insert it deeply enough and carefully enough to obtain a good seal. Users are reluctant to push the cushion deeply enough into the ear, for fear of causing damage to the ear if inserted to deeply. This problem is common to that found with earplugs, and studies show that users are not very adept at obtaining the best performance from these devices (see Elliott H. Berger, "The Naked Truth About NRRs," EAR Hearing Protection Products; 1993; reproduced in EARLog by EAR Aearo Company).

A further type of ear seal can be found on earbuds such as the MDR-NC11 noise-canceling earbud headphones made by Sony Electronics Inc. These use a variant of the mushroom tip utilizing just a single cap, again with different sizes to accommodate different ears. This style of earbud generally employs a moving coil transducer having a larger diaphragm than the balanced armature devices, but still requires a good seal for reproduction of the bass frequencies. The tips have the same issues as with the multiple cap approach but are not designed to fit as far into the ear and suffer from the same problems of poor seal and poor isolation, exacerbated by the shallow insertion.

It would therefore be advantageous to provide an earphone device that overcomes one or more of the aforementioned problems, disadvantages or drawbacks. It would further be advantageous to provide an earphone device such as an earbud fitting into the ear canal that generally requires less skill or attention from the wearer whilst potentially providing other additional benefits including, for example, an improved seal, a higher acoustic impedance cushion and/or a more secure fit in the ear to improve the bass response of the earbud. It would also be advantageous to provide an earphone device that provides more effective noise isolation and improved consistency of fit and performance.

SUMMARY OF THE INVENTION

In one aspect, an apparatus and method is provided for fitting an insertion type of earbud to the ear canal by using a compressible material to form a seal and a manual element for controlling the compression of the compressible material.

In one embodiment, an earphone device comprises a housing having a body terminating in an acoustic output port, at least one drive unit disposed inside the housing, a compressible material (such as a foam bulb) at least partially surrounding a portion of the body proximate the output port, and an adjustable member having a plurality of positions. When the adjustable member is in a first position the compressible material is relatively non-compressed, and when the adjustable member is in a second position the compressible material is relatively compressed. The adjustable member may take the form, for example, of a pivoting lever, a helical cam, or a push-rod mechanism, among other things. The casing may have a body enclosing the one or more drive units, and a narrower hollow extension member (such as a hollow post) terminating in the acoustic output port. A movable cap may be disposed at an end of the casing, with the hollow extension member passing through it. A flange may be disposed around the periphery of the movable cap, in order to provide a seal surrounding the ear canal region. The compressible material may be gripped by the hollow extension member, and abut the movable cap or flange. The compressible material may be decompressed and thus narrowed or elongated, through actuation of the adjustable member, for insertion into the wearer's ear, and may be compressed and thus widened or expanded, through further actuation of the adjustable member, to enlarge the compressible material so as to form an adequate seal with the wearer's ear canal region.

According to various embodiments as disclosed herein, an insertion earbud type earphone device may generally require less skill or attention from the wearer as compared to conventional earphone devices, whilst potentially providing other additional benefits including an improved seal, a higher acoustic impedance cushion and/or a more secure fit in the ear to improve the bass response of the earbud, and whilst providing more effective noise isolation and improved consistency of fit and performance.

Further embodiments, variations and enhancements are also disclosed herein.

DETAILED DESCRIPTION OF PREFERRED EMBODIMENTS

Figure 1:
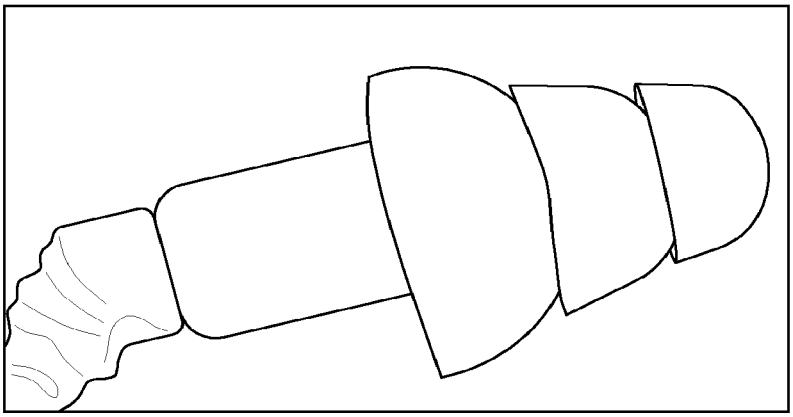
FIG. 1 (PRIOR ART)
FIG. 1 is an illustration of one type of prior art earbud for headphones.
Figure 2:
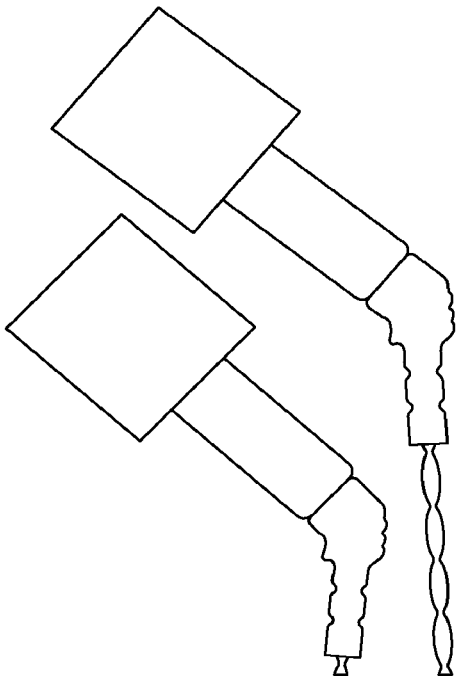
FIG. 2 (PRIOR ART)
FIG. 2 is an illustration of another type of prior art earbud for headphones.
Figure 3:
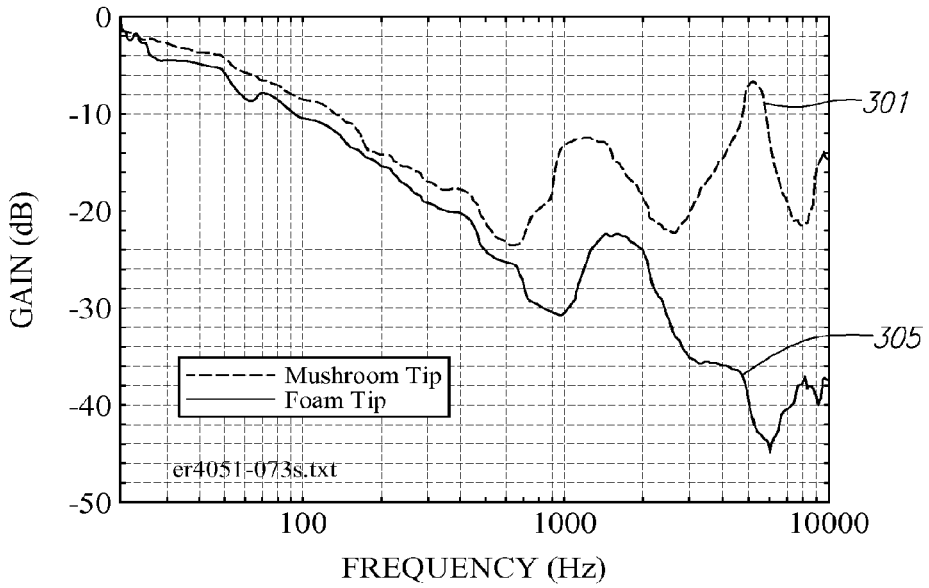
FIG. 3 is a graph comparing the attenuation characteristics of the prior art earbuds illustrated in FIGS. 1 and 2.

According to one or more embodiments as disclosed herein, an earphone device comprises an earbud housing having casing enclosing one or more drive units, a hollow extension member terminating in an acoustic output port through which the sound output from the drive units is directed, a compressible material (such as a foam bulb) at least partially surrounding a portion of the body proximate the output port, and an adjustable member (such as a manual lever, push-rod, or helical cam) controlling the shape of the compressible material. When the adjustable member is moved into a first position, the compressible material becomes relatively non-compressed and elongate, allowing easy insertion into the ear canal. When the adjustable member is moved into a second position, the compressible material is relatively compressed and widens, thus forming a snug seal with the ear canal. A movable cap may be disposed at an end of the casing, with a flange disposed around its periphery in order to provide a secondary seal surrounding the ear canal region. The hollow extension member may be flared so as to grip the compressible material and pull the material against, or push it away from, the movable cap and/or flange. The compressible material may thereby be decompressed and thus narrowed or elongated, or compressed and thus widened or expanded to form a seal with the wearer's ear canal.

A drawing of one embodiment of an earphone device 400 is shown in FIG. 4. An earbud casing 401 with acoustic port 404 (which may comprise an opening at the tip of a hollow tube or postlike member 419 protruding from the earbud casing 401) sits inside cap 403, all preferably made from a rigid material such as for example, a nylon based plastic. Disposed inside the earbud casing 401 are one or more drive units (not shown), such as, for example, a miniature armature drive unit or two or more miniature balanced armature drive units, possibly in conjunction with a small dynamic driver for low frequencies, all as conventionally known in the art. The drive unit(s) sound output emanates from the opening at the tip of acoustic port 404, and receive a signal from wire or cable 430 connected to the earbud casing 401. The cap 403 preferably is outfitted with a flexible, compliant flange 406, covering and sealing to it, although in some embodiments flange 406 may be omitted. Flange 406 fits against the entrance to the ear canal and is preferably flexible enough to conform to the contours of the ear canal entrance to provide for a comfortable fit and to form at least a partial acoustic seal to it. The earbud casing 401 slides back and forth within the cap 403, aided by a lever 402 having offset cam expanding element 407 as it slides outwards. The contoured edge of the lever 402 rests against the back of the cap 403, which moves back and forth relative to the casing 401 as the lever 402 is manually actuated. Element 407 can comprise either a compliant foam, a spring, or some other stretchable or expandable material.

Figure 4A:
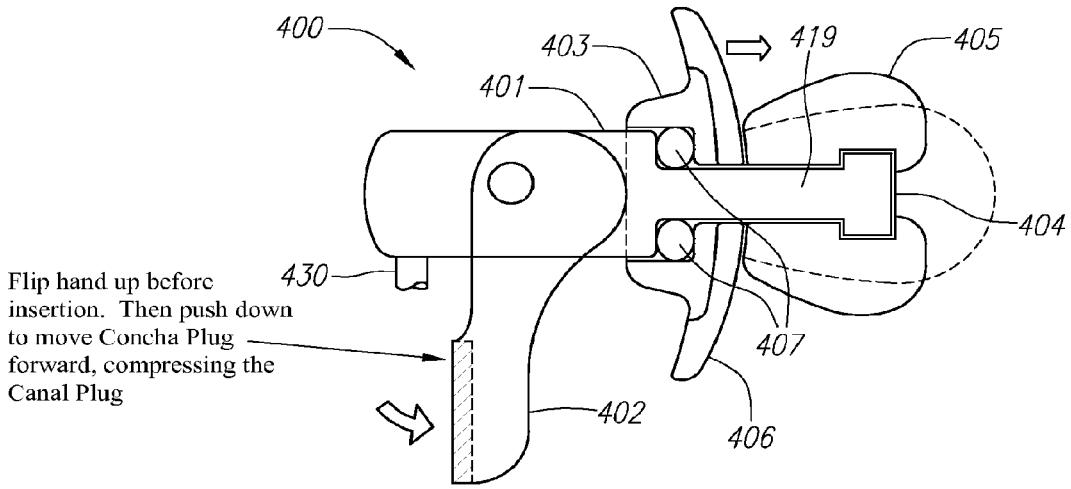
FIG. 4A is a diagram in partial cross-section of an earphone device in accordance with one embodiment as disclosed herein, having a manual lever for compressing a foam cushion or other similar material prior to or during insertion in the ear canal.

Surrounding the hollow post member 404, according to a preferred embodiment, is a cushion 405. Cushion 405 comprises a deformable material, shaped such that when the earbud casing 401 is positioned forward inside cap 403 it is relatively long and narrow in profile. As the earbud casing 401 moves backwards away from cap 403, cushion 405 is shortened from front to back, thereby changing its shape from relatively long and thin to relatively short and fat. The lever 402 is used to move the earbud casing 401 back and forth within cap 403. The lever 402 has an offset cam arrangement to give two stable positions—vertical as shown in FIGS. 4A and 4C, or horizontal as shown in FIG. 4B.

Figure 4B:
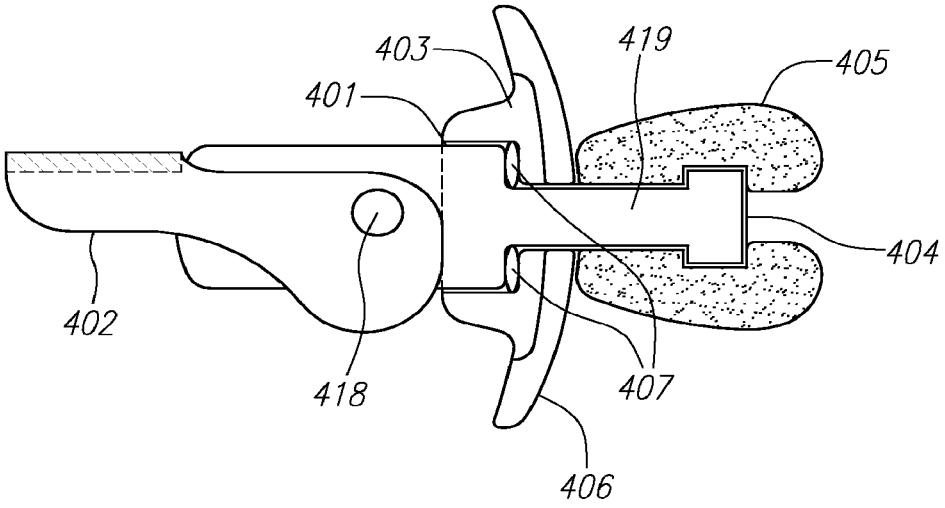
FIGS. 4B and 4C are diagrams illustrating operation of the manual lever in greater detail.
Figure 4C:
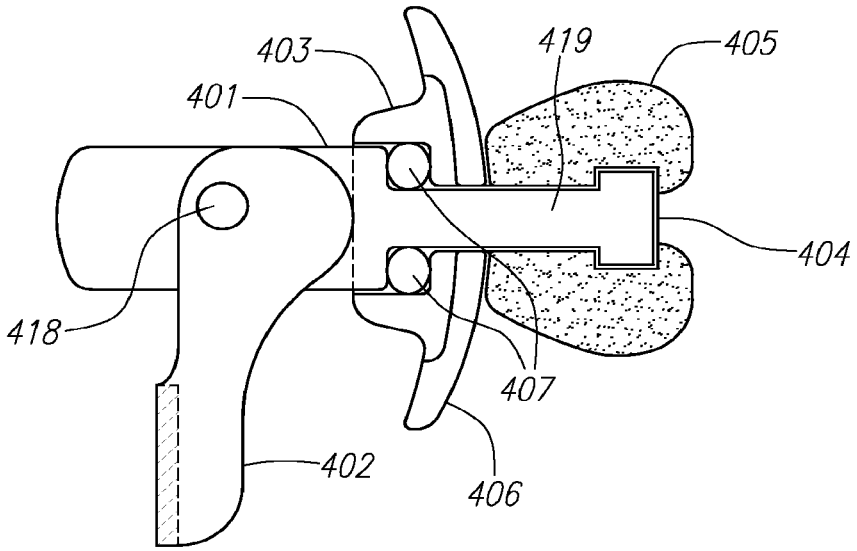

In use, the lever 402 is set to the horizontal position before the earbud is inserted into the ear canal, elongating the cushion 405, as shown in FIG. 4B. This action makes the cushion 405 small enough in cross section that it easily slides into the ear canal. The contour of the lever 402 is such that the distance from the pivot point 418 to the base of the cap 403 is shorter when the lever 402 is in a horizontal position. As a result, the cap 403 slides down the hollow post member 404, as the pressure of the cushion 405 pushes it in that direction, allowing the cushion 405 to elongate and thus narrow in profile. At the same time, complaint material 407 between the earbud casing 401 and the cap 403 may be compressed. The cushion 405 is inserted into the ear canal far enough so that flange 406 preferably rests against the outside of the ear canal entrance and prevents further entry. Once the cushion 405 is in place, the lever 402 is then moved to the vertical position, as illustrated in FIG. 4C. This action shortens the cushion 405 and expands it outwards until it meets the walls of the ear canal. The cushion 405 then compresses against the ear canal walls to form an acoustic seal. As it does so it grips the ear canal so that the shortening action of the lever motion draws the compliant flange 406 further forward against the ear canal entrance and improves the overall grip of the earbud 400.

In this example, the flared tip of the postlike member 419 serves to grip the cushion 405, although other means (such as a ring located elsewhere on the postlike member 419, or small hooklike members along the sides of postlike member 419, or adhesive) may be used to allow the cushion to be at least partially held by the postlike member 419 as the cap 403 moves relative thereto. The cushion 405 may thus be gripped at any suitable point along the length of the postlike member 419.

As a result of the ability to obtain a greater outward expansion of the cushion by means of the front/back compression, the cushion 405 need not protrude as deeply into the ear canal as a conventional earbud tip and thus is more comfortable and hygienic. The requirement of a lesser insertion distance is helped by the use of flange 406 which acts both as an end stop, preventing the cushion 405 being inserted too deeply, and an aid to overall grip, squeezing the ear canal entrance between the flange 406 and the cushion 405. The insertion depth limiting action of the flange 406 also lessens any anxiety of the wearer regarding the cushion 405 being inserted too deeply. Additionally, flange 406 may also be made compliant enough to deform to the shape of the area around the ear canal entrance and thus form a secondary acoustic seal to the outside of the ear canal.

Because the fit of the earbud cushion 405 does not rely solely upon the ability of the material to expand from a compressed condition, it can utilize a greater range of materials than conventional earbuds. It may be made, for example, from a suitable foam, with or without a skin, or as a silicone teat, with or without a foam filling. These materials can be chosen for improved stability, comfort, hygiene etc. compared to conventional earbud cushions.

Since different user's ear canals differ in size and shape, the lever 402 may incorporate an adjustable mechanism to alter the range of back and forth motion of the earbud casing 401 within cap 403, thus altering the maximum expansion of the cushion 405. This adjustable mechanism may, for example, take the form of the screw adjustment conventionally utilized in "Mole Grip" type locking pliers.

The mechanism described is not constrained for use on a purposely designed earbud. It may also be adapted to act as a carrier for existing earbuds, thus endowing them with the benefits of an improved fit and extra comfort.

Figure 5:
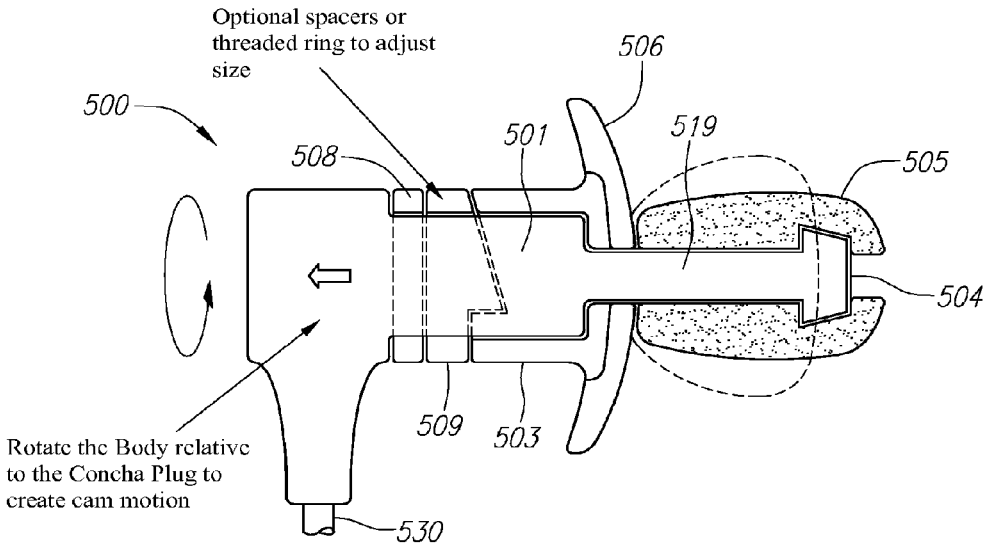
FIG. 5 is a diagram in partial cross-section of another embodiment of an earphone device, having a rotatable member causing compression of a foam cushion or other similar material prior to or during insertion in the ear canal.

The mechanism for contracting and expanding the cushion 405 is not limited to that shown in FIGS. 4A-4C. An alternative arrangement is detailed in FIG. 5, where instead of a lever action a rotational action is used along with a helical cam 509 to move the casing 501 back and forth. Similar to FIG. 4A, the embodiment shown in FIG. 5 has an earbud casing 501 with acoustic port 504 sitting inside a cap 503, all as before preferably made from a rigid material such as, for example, a nylon based plastic. The acoustic port 504 is preferably disposed at the tip of a hollow postlike member 519, similar to that of FIG. 4A The cap 503 preferably has a flexible, compliant flange 506 which fits against the entrance to the ear canal and, by preferably conforming to the contours of the ear canal entrance, provides for a comfortable fit and at least a partial acoustic seal thereto. In use, the body of the casing 501 is rotated relative to the cap 503 in order to compress and decompress the cushion 505, in a manner similar to the embodiment of FIGS. 4A-4C. In this example, the flared tip of the postlike member 519 serves to grip the cushion 505, although other means (such as a ring located elsewhere on the postlike member 519, or small hooklike members along the postlike member 519, or adhesive) may be used to allow the cushion to be at least partially held by the postlike member 519 as the cap 503 moves relative thereto. Also shown is an optional spacer 508 (or alternatively a threaded ring) that can be used to limit the range of adjustment, if required, for different ears in order to maximize comfort. A similar spacer ring could also be used for the same purpose in the embodiment shown in FIG. 4A and would, for example, be placed between the cam lever 402 and cap 403, or may be used in other embodiments described herein.

Figure 6:
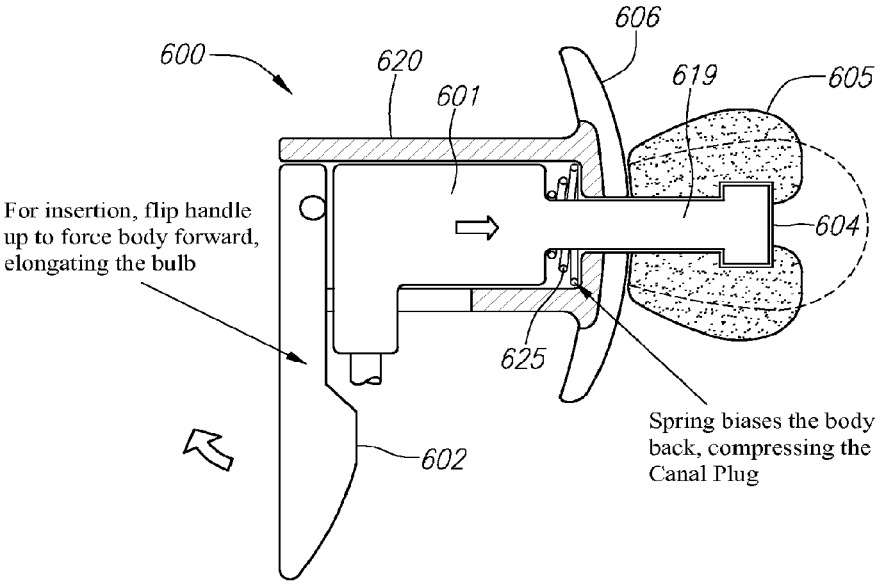
FIG. 6 is a diagram in partial cross-section of another embodiment of an earphone device, utilizing a manual lever for compressing a foam cushion or similar material prior to insertion or during in the ear canal.

FIG. 6 is a diagram in partial cross-section of another embodiment of an earphone device 600, utilizing a manually actuatable lever 602 for compressing a foam cushion 605 or similar material prior to insertion or during in the ear canal. Similar to FIG. 4A, the embodiment shown in FIG. 6 has an earbud casing 601 with acoustic port 604, sitting inside an elongate cap 620, all as before preferably made from a rigid material such as, for example, a nylon based plastic. The acoustic port 604 is preferably disposed at the tip of a hollow postlike member 619 or other similar hollow tube, similar to that of FIG. 4A The elongate cap 620 preferably has a flexible, compliant flange 606 which, as before, fits against the entrance to the ear canal and provides at least a partial acoustic seal thereto. A foam cushion 605 at least partially surrounds the postlike member 619. A spring 625 is disposed in the cavity between the forward edge of the earbud casing 601 and the portion of the elongate cap 620 on the backside of the flange 606.

In use, the lever 602 is set to the horizontal position before the earbud is inserted into the ear canal, elongating the cushion 605, as previously described with respect to the example in FIG. 4B. The lever 602 is cantilevered, so that the tip of lever 602 presses the rear of the earbud casing 601 forward, thereby compressing spring 625 and forcing the postlike member 619 forward relative to the flange 606 and elongate cap 620. This action makes the cushion 605 small enough in cross section that it easily slides into the ear canal. At the same time, the spring 625 is compressed. The cushion 605 is inserted into the ear canal far enough so that flange 606 preferably rests against the outside of the ear canal entrance and prevents further entry. Once the cushion 605 is in place, the lever 602 is then moved to the vertical position, as previously illustrated with respect to the example in FIG. 4C. This action, along with the expansion of sprint 625, shortens the cushion 605 and expands it outwards until it meets the walls of the ear canal. The cushion 605 then compresses against the ear canal walls to form an acoustic seal. As it does so it grips the ear canal so that the shortening action of the lever motion draws the compliant flange 606 further forward against the ear canal entrance and improves the overall grip of the earbud 600.

In this example, the flared tip of the postlike member 619 serves to grip the cushion 605, although other means as previously described may be used to allow the cushion 605 to be at least partially held by the postlike member 619 as the elongate cap 603 moves relative thereto.

Figure 7:
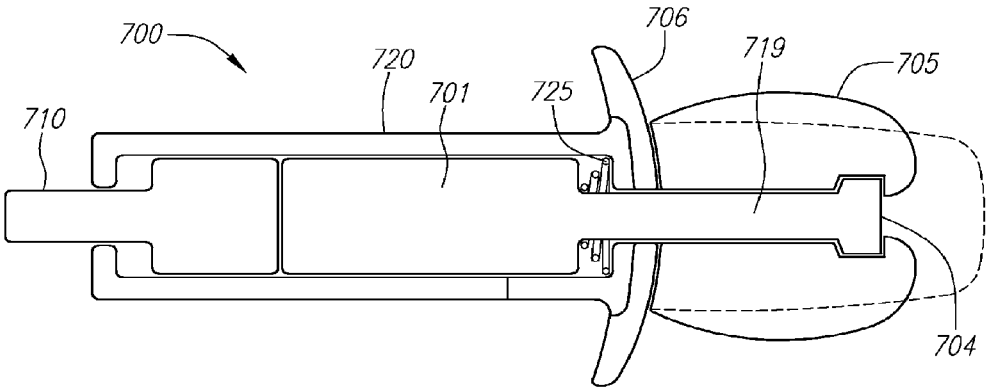
FIG. 7 is a diagram in partial cross-section of another embodiment of an earphone device, having a spring-loaded post member allowing compression of a foam cushion or other similar material prior to or during insertion in the ear canal.

FIG. 7 is a diagram in partial cross-section of another embodiment of an earphone device 700, having a spring-loaded push rod 710 for controlling compression of a foam cushion or other similar material prior to or during insertion in the ear canal. The embodiment shown in FIG. 7 has an earbud inner casing 701 with acoustic port 704, sitting inside a cylindrical outer casing 720, all as before preferably made from a rigid material such as, for example, a nylon based plastic. The acoustic port 704 is preferably disposed at the tip of a hollow postlike member 719, as described with respect to the previous embodiments The cylindrical outer casing 720 preferably has a flexible, compliant flange 706 which, as before, fits against the entrance to the ear canal and provides at least a partial acoustic seal thereto. A foam cushion 705 at least partially surrounds the postlike member 719. A spring 725 is disposed in the cavity between the forward edge of the earbud inner casing 701 and the portion of the cylindrical outer casing 720 on the backside of the flange 706. The earphone device 700 includes a double push mechanism similar to ballpoint pens, wherein depressing the push rod 710 a first time locks the earbud inner casing 701 in a forward position with the postlike member 719 fully extended, while depressing the push rod 710 a second time releases the earbud inner casing 701 and allows the postlike member 719 to retract. Examples of some double push mechanisms that may be used for this purpose are described in, e.g., U.S. Pat. Nos. 6,921,225 and 3,724,961, both of which are hereby incorporated by reference as if set forth fully herein.

In use, the push rod 710 is actuated in a manner similar to a ballpoint pen, with the wearer pushing the push rod 710 towards the earbud inner casing 701. This action forces the earbud inner casing 701 forward, elongating the cushion 705, as previously described with respect to the example in FIG. 4B and other previous embodiments. The earphone device 700 comprises a double push mechanism similar to ballpoint pens, wherein a first push of the push rod 710 causes the earbud inner casing 701 to lock in the forward position. At the same time, the spring 725 is compressed. At this point, the cushion 705 is narrow enough so that it easily slides into the ear canal. As before, the cushion 705 is inserted into the ear canal far enough so that flange 706 preferably rests against the outside of the ear canal entrance and prevents further entry. Once the cushion 705 is in place, the wearer than pushes the push rod 710 a second time, releasing the locking mechanism, and allowing the earbud inner casing 701 to retract. This action, along with the expansion of sprint 725, shortens the cushion 705 and expands it outwards until it meets the walls of the ear canal. The cushion 705 then compresses against the ear canal walls to form an acoustic seal. As it does so it grips the ear canal so that the shortening action of the lever motion draws the compliant flange 706 further forward against the ear canal entrance and improves the overall grip of the earbud 700.

Figure 8:
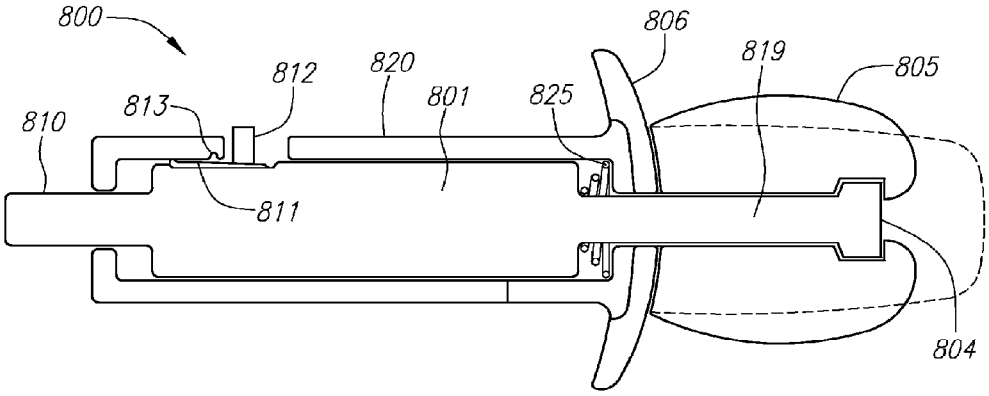
FIG. 8 is a diagram in partial cross-section of yet another embodiment of an earphone device, having a spring-loaded post member and a locking mechanism allowing compression of a foam cushion or other similar material prior to or during insertion in the ear canal.

FIG. 8 is a diagram in partial cross-section of yet another embodiment of an earphone device 800, having a spring-loaded push mechanism generally similar in principle to that of FIG. 7, for controlling compression of a foam cushion or other similar material prior to or during insertion in the ear canal. The embodiment shown in FIG. 8 has an earbud inner casing 801 with acoustic port 804, sitting inside a cylindrical outer casing 820, all as before preferably made from a rigid material such as, for example, a nylon based plastic. A manually actuatable push rod 810 extends from the distal end of the earbud inner casing 801. The acoustic port 804 is preferably disposed at the tip of a hollow postlike member 819, as described with respect to the previous embodiments The cylindrical outer casing 820 preferably has a flexible, compliant flange 806 which, as before, fits against the entrance to the ear canal and provides at least a partial acoustic seal thereto. A foam cushion 805 at least partially surrounds the postlike member 819. A spring 825 is disposed in the cavity between the forward edge of the earbud inner casing 801 and the portion of the cylindrical outer casing 820 on the backside of the flange 806.

The earbud inner casing 801 also has an inset pin member 811 attached to and running in parallel with it, terminating in a small V-shaped or hook-shaped tip. The pin member 811 also has a perpendicular extension 812 that protrudes out of a grooved or slotted opening in the cylindrical outer casing 820. The cylindrical outer casing 820 further has, on its interior wall proximate the pin member 811, a dimple or other impression generally matching the shape of the V-shaped or hook-shaped tip of the pin member 811, for controllably locking the earbud inner casing 801 in position.

In use, the push rod 810 is actuated in a manner similar to a ballpoint pen, with the wearer pushing the push rod 810 thus forcing the earbud inner casing 801 in a forward direction, elongating the cushion 805, as previously described with respect to the example in FIG. 4B and other previous embodiments. The earphone device 800 operates similar to the mechanism of a ballpoint pen, wherein a first push of the push rod 810 causes the earbud inner casing 801 to lock in the forward position, as the pin member 811 slide forward until its V-shaped or hook-shaped tip locks into the dimple or impression 813. At the same time, the spring 825 is compressed. At this point, the cushion 805 is narrow enough so that it easily slides into the ear canal and, as before, it is inserted into the ear canal far enough so that flange 806 preferably rests against the outside of the ear canal entrance and prevents further entry. Once the cushion 805 is in place, the wearer than pushes down on the extension 812 of the pin member 811, releasing the tip of the pin member 811 from the dimple or impression 813, and allowing the earbud inner casing 801 to retract. This action, along with the expansion of sprint 825, shortens the cushion 805 and expands it outwards until it meets the walls of the ear canal. The cushion 805 then compresses against the ear canal walls to form an acoustic seal. As it does so it grips the ear canal so that the shortening action of the lever motion draws the compliant flange 806 further forward against the ear canal entrance and improves the overall grip of the earbud 800.

With either of the examples described in FIG. 7 or 8, the flared tip of the postlike member 719 or 819 serves to grip the cushion 705 or 805; however, other means as previously described may be used to allow the cushion to be at least partially held by the postlike member as it moves relative to the cylindrical outer casing.

In some embodiments, the cylindrical, hollow postlike member may take other shapes or forms. For example, it may be generally tapered or funnel-shaped, i.e., broader near the cap and narrowing towards the acoustic output port. The acoustic output port may also be square, rectangular, oval, or oblong in shape, as may be the hollow postlike member (from a cross-sectional vantage point, looking towards the cap). Similarly, various embodiments have been described with a compliant flange for resting against the ear canal walls, thus providing an end-stop, but in other embodiments the flange may be omitted.

Figure 9A:
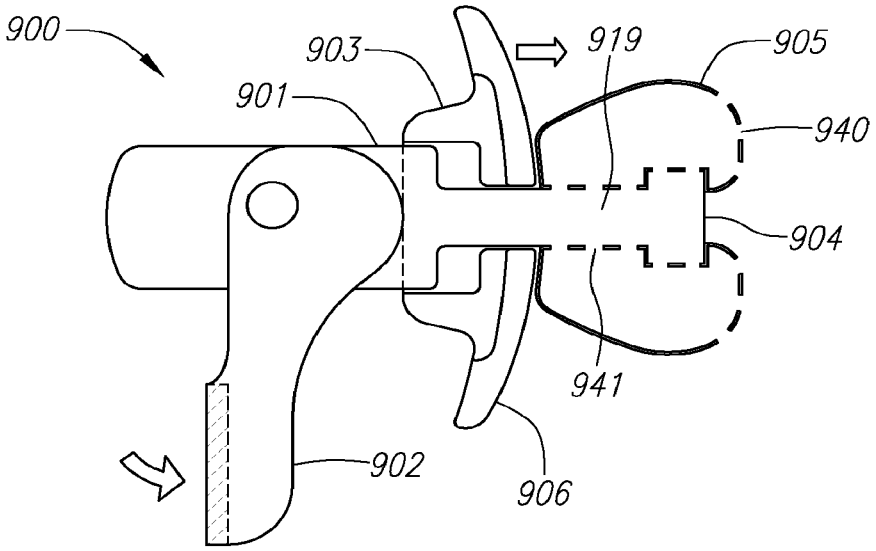
FIG. 9A is an diagram of an earphone device similar to that of FIG. 4A, but having a partially acoustically transparent postlike member with holes or similar perforations along its length.
Figure 9B:
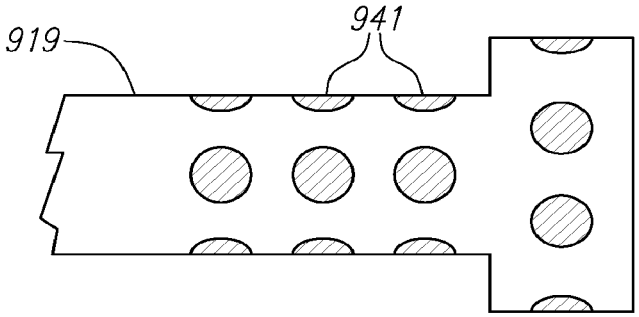
FIG. 9B is a diagram showing an exemplary pattern of holes or perforations on the postlike member.

Additionally, in some embodiments, the hollow postlike member may be at least partially acoustically transparent along a part of its length. For example, FIG. 9A is an diagram of an earphone device 900 similar to that of FIG. 4A, but having a partially acoustically transparent postlike member 919 with holes or similar perforations 941 along its length. The holes or perforations 941 may be circular or elongate, thus ranging from circular or ovoid holes to narrower slits. The pattern of holes or perforations 941 may be regular and repeating, or irregular. One example of a pattern of holes is illustrated in FIG. 9B The holes or perforations 941 preferably line up with similarly situated holes in the cushion 905, which is also at least partially acoustically transparent at it outer periphery 940. Such an arrangement provides for a less restrictive coupling into the ear canal while still providing a seal to the ear canal against external noise.

In other embodiments, different mechanisms may be utilized to compress and decompress a bulbed cushion to allow insertion in the ear with a sealed fit, similar to the examples previously described. For example, a pair of opposing lever members (similar to alligator clips or a clothespin-type mechanism) may be manually actuated, i.e., pressed together, to spin a small gear or cam thus moving the earbud casing relative to a cap or outer casing, thus causing the foam cushion to compress, and may be released when desiring to decompress the foam cushion. Similarly, a syringe-like mechanism, with a spring bias, may also be used to control compression and decompression of the cushion.

In other embodiments, the compressible material may take the form of a deformable membrane that is selectively shaped (expanded or narrowed) by virtue of moving the adjustable member, as previously described. The membrane may be made, for example, from a thin silicone rubber, latex, or the like, and may be reinforced or padded if desired. In a membrane version of the earphone device, the extension and shortening of the protruding stem or hollow tube either expands or compresses the shape of the membranous bulb by deforming it, rather than compressing a bulk material such as foam. The inherent compliance of the membrane causes it to form into the desired expanded or compressed shape. The action of the adjustable member serves to at least partially compress the material of the deformable membrane thus influencing the shape of the membrane according to its inherent compliance.

While various embodiments have generally been described in the context of earphones for listening to music, it will be appreciated that the invention is not limited to music sound reproduction, but that is may also find application in other areas such as for hearing aides and the like.

According to various embodiments as disclosed herein, an earphone device is provided having benefits and advantages including one or more of improved fit with the wearer's ear canal, improved comfort, and superior seal for improved sound, all with an easy to use manual mechanism. Such an earphone device may be relatively simple and easy to construct, and inexpensive to manufacture, and may also provide additional benefits and advantages.

While preferred embodiments of the invention have been described herein, many variations are possible which remain within the concept and scope of the invention. Such variations would become clear to one of ordinary skill in the art after inspection of the specification and the drawings. The invention therefore is not to be restricted except within the spirit and scope of any appended claims.

What is claimed is:

1. An acoustic earphone device, comprising:

a casing enclosing at least one drive unit therein;

a hollow extension member protruding from said casing and terminating in an acoustic output port;

a movable cap disposed on the exterior of said casing, and slidably engaged therewith, such that the hollow extension member passes through the movable cap;

a flexible flange surrounding the movable cap, said flexible flange adapted to create a seal surrounding the ear canal region when pressed thereto;

a compressible elastic bulb at least partially surrounding the hollow extension member and gripped thereby; and a manually actuable pivoting lever connected to said casing such that when the lever is pivoted the movable cap slides relative to said casing;

wherein relative motion of the movable cap with respect to the hollow extension member causes the compressible elastic bulb to decompress, thus becoming relatively elongate and narrow, or to compress, thus becoming relatively wide and squat.

2. The acoustic earphone device of claim 1, wherein said compressible elastic bulb comprises acoustic foam polymer or rubber placed in direct contact with a wearer's ear, and returns to its original elongate and narrow shape when the movable cap causes the compressible elastic bulb to decompress.

3. An earphone device, comprising:

a housing encasing at least one drive unit therein;

a signal wire coupled to said housing, for conveying an input audio signal from an external source;

a rigid hollow tube protruding from a front side of said housing and terminating in an acoustic output port, said rigid hollow tube having a width narrower than a width of said housing;

a rotatable member disposed on a back side of said housing and protruding therefrom; and a compressible elastic material surrounding the exterior of the hollow tube, said compressible elastic material adapted for direct contact with a wearer's ear canal;

wherein rotation of said rotatable member in one direction applies a force to the compressible elastic material causing it to expand in relative width, and wherein rotation of said rotatable member in an opposite direction relaxes the force applied to the compressible elastic material causing it to contract in relative width.

4. The earphone device of claim 3, wherein expansion of the compressible elastic material in response to the force applied due to said rotatable member causes the compressible elastic material to substantially form a seal within a wearer's ear canal, and wherein contraction of the compressible material in response to rotation of said rotatable member in the opposite direction causes the seal to be broken.

5. An earphone device, comprising:

a first casing enclosing at least one drive unit therein and comprising a rigid hollow tube terminating in an acoustic output port;

a movable cap or outer casing disposed on the exterior of said first casing such that the hollow tube passes through an opening in the movable cap or outer casing; and a compressible elastic material at least partially surrounding the exterior of the rigid hollow tube and gripped thereby;

wherein the earphone device further comprises a manually actuatable portion which is coupled to the first casing, is separated from the compressible elastic material by the movable cap or outer casing, and displaces the position of said movable cap depending on manual operation, and wherein relative motion of the movable cap or outer casing with respect to the hollow tube causes the compressible elastic material to compress or decompress, the compressible elastic material being gradually squeezed as the movable cap or outer casing presses against it while moving forward relative to the acoustic output port of the hollow tube and being gradually released as the movable cap or outer casing moves away from the acoustic output port.

6. The earphone device of claim 5, wherein said compressible elastic material comprises a foam or rubber bulb.

7. The earphone device of claim 5, wherein said hollow tube comprises a flared tip for gripping the compressible elastic material.

8. The earphone device of claim 5, wherein said movable cap or outer casing is slidably engaged with said first casing.

9. The earphone device of claim 5, further comprising a manually actuatable lever as the manually actuatable portion.

10. The earphone device of claim 9, wherein said lever has a contoured profile abutting the movable cap or outer casing, such that when the lever moves into a first position the movable cap or outer casing moves further away from the acoustic output port and allows the compressible elastic material to decompress, and when the lever moves into a second position the movable cap or outer casing moves closer towards the acoustic port and provides a force for compressing the compressible elastic material while it remains gripped by the rigid hollow tube.

11. The earphone device of claim 9, further comprising a spring disposed between an exterior surface of said first casing and an inner surface of said movable cap or outer casing, wherein said lever is cantilevered about a pivot point such that when the lever moves into a first position an end of the lever presses the first casing forward relative to the movable cap or outer casing thereby moving the acoustic output port further away from the first casing and allowing the compressible material to decompress, and when the lever moves into a second position the spring pushes the first casing away from the movable cap or outer casing thereby moving the acoustic port closer to the first casing and causing compression of the compressible elastic material.

12. The earphone device of claim 5, further comprising a helical cam for adjusting a position of said first casing relative to said hollow tube as the manually actuatable portion.

13. The earphone device of claim 5, further comprising a manually actuatable push rod for adjusting a position of said first casing relative to said hollow tube as the manually actuatable portion.

14. The earphone device of claim 13, wherein when said push rod is in a first position, the first casing is pushed forward towards the interior surface of the movable cap or outer casing thereby decompressing the compressible elastic material and compressing said spring, and when said push rod is in a second position, a spring pushes the first casing away from the interior surface of said movable cap or outer casing thereby compressing the compressible elastic material.

15. The earphone device of claim 5, wherein said compressible elastic material is placed in direct contact with a wearer's ear, and wherein it reverts to its original shape when the movable cap or outer casing moves away from the acoustic output port, allowing the compressible elastic material to decompress.

16. The earphone device of claim 5, wherein said at least one drive unit is disposed within said casing, and wherein said hollow tube is narrower than the casing.

17. The earphone device of claim 5, further comprising a flexible flange disposed around a periphery of said movable cap or outer casing, said hollow tube protruding through said flexible flange, wherein said compressible elastic material abuts said flexible flange, said flexible flange providing a seal for a wearer's ear canal region.

18. The earphone device of claim 5, wherein placement of the manually actuatable portion in a first position causes the compressible material to decompress and elongate along the axis of the hollow tube, and wherein placement of the manually actuatable portion in a second position causes the compressible elastic material to compress against the flexible flange and widen along in a direction perpendicular to the axis of the hollow tube.

19. The earphone device of claim 5, further comprising a spring disposed between a backside of said movable cap or outer casing and a surface of said first casing.

20. The earphone device of claim 5, further comprising a spring disposed around said hollow tube and between an interior surface of said movable cap or outer casing and an exterior surface of said first casing.

21. The earphone device of claim 5, wherein said compressible elastic material comprises an acoustic foam or rubber bulb placed in direct contact with a wearer's ear.

22. The earphone device of claim 5, wherein said at least one drive unit comprises two or more miniature balanced armature drive units.

23. The earphone device of claim 5, wherein said manually actuatable portion is integral with the first casing.

* * * * *